US010674296B2

(12) United States Patent
Battacharya et al.

(10) Patent No.: US 10,674,296 B2
(45) Date of Patent: Jun. 2, 2020

(54) MICROPHONE BIAS APPARATUS AND METHOD

(71) Applicant: CIRRUS LOGIC INTERNATIONAL SEMICONDUCTOR LTD., Edinburgh (GB)

(72) Inventors: Anindya Battacharya, Austin, TX (US); Bhoodev Kumar, Austin, TX (US); John L. Melanson, Austin, TX (US); Vivek Oppula, Austin, TX (US); Anuradha Parsi, Austin, TX (US); Qi Cai, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/046,943

(22) Filed: Jul. 26, 2018

(65) Prior Publication Data

US 2019/0037327 A1 Jan. 31, 2019

Related U.S. Application Data

(60) Provisional application No. 62/538,220, filed on Jul. 28, 2017.

(51) Int. Cl.
*H04R 3/00* (2006.01)
*H04R 29/00* (2006.01)
(Continued)

(52) U.S. Cl.
CPC ..... *H04R 29/005* (2013.01); *H04R 1/406* (2013.01); *H04R 3/005* (2013.01); *G05F 3/262* (2013.01)

(58) Field of Classification Search
CPC ..... H04R 1/326; H04R 1/406; H04R 3/00; H04R 3/005; H04R 3/02; H04R 3/10;
(Continued)

(56) References Cited

U.S. PATENT DOCUMENTS 6,608,905 B1 * 8/2003 Muza ..... H04R 29/004 330/262
7,864,970 B2 * 1/2011 Niwa ..... H03F 1/0211 330/250
(Continued)

*Primary Examiner* — Xu Mei
(74) *Attorney, Agent, or Firm* — E. Alan Davis; James W. Huffman

(57) ABSTRACT

An apparatus for biasing a plurality of microphones includes a sensing circuit that actively senses a local ground reference for each microphone. An intermediate stage receives a constant non-local reference voltage as an input and responsively provides a respective constant local reference signal (e.g., current) with respect to each of the actively sensed local ground references. For each microphone, a respective microphone bias block uses the respective constant local reference signal to generate a respective constant local microphone bias voltage to bias the microphone. For each microphone, a variable RC network uses the respective constant local reference current to generate a constant local reference voltage for the microphone. Each RC network is controllable in response to the respective actively sensed local ground reference to independently set the respective local microphone bias voltage. A sensing circuit may actively sense the local microphone bias voltages to control local microphone bias voltage generation.

20 Claims, 5 Drawing Sheets

(51) Int. Cl.
*H04R 1/40* (2006.01)
*G05F 3/26* (2006.01)

(58) Field of Classification Search
CPC .... H04R 29/00; H04R 29/004; H04R 29/005; H04R 29/006; H04R 2203/00; H04R 2410/00; G05F 3/262
USPC .... 381/91, 92, 122, 111–115, 120, 121, 123, 381/174; 330/278, 297, 261, 267, 273, 330/279, 285, 296, 199
See application file for complete search history.

(56) References Cited

U.S. PATENT DOCUMENTS

| | | | | |
|---|---|---|---|---|
| 8,189,815 | B2 * | 5/2012 | Chen | H04R 3/00 330/253 |
| 9,710,000 | B2 * | 7/2017 | Yamada | H03F 3/187 |
| 10,225,653 | B2 * | 3/2019 | Melanson | H04R 1/1041 |
| 2012/0250881 | A1 * | 10/2012 | Mulligan | H03F 1/0261 381/92 |
| 2014/0064523 | A1 * | 3/2014 | Kropfitsch | H03G 1/0094 381/174 |
| 2016/0065152 | A1 * | 3/2016 | Kropfitsch | H03F 1/56 381/113 |

* cited by examiner

MICROPHONE BIAS APPARATUS AND METHOD

BACKGROUND

A microphone bias (micbias) block, or circuit, provides a regulated low noise voltage to an analog microphone. In applications such as cell phones, conventionally there are several microphones that are independently biased by dedicated micbias blocks. The microphones in such applications are typically placed far from each other resulting in significant ground mismatch between them. A conventional high-performance micbias block has an output pin (e.g., MIC1_BIAS in FIGS. 1 and 2) and a filter pin (e.g., MIC1_BIAS_FILT in FIG. 1 and MICBIAS_FILT in FIG. 2). The filter pin requires a large capacitor (e.g., 4.7 μF in metric 0402 size, e.g., C_EXT_FILT1 in FIG. 1 and C_EXT_FILT in FIG. 2) for each micbias block, primarily to meet low noise and high Power Supply Rejection Ratio (PSRR) requirements. The filter pin is referenced to the local microphone ground which helps with system level noise rejection. A dedicated filter capacitor requirement for each micbias block may add significant area and cost to the end application.

Referring now to FIG. 1, a diagram illustrating a prior art microphone bias scheme employing an external capacitor for each of N microphones is shown. A voltage reference, MIC1_BIAS_FILT, with respect to chip ground, CHIP_GND, which is remote/non-local to a microphone MIC1 102-1, is generated using a bias current IB1 104-1 and a resistor RBG1. The voltage reference MIC1_BIAS_FILT is filtered using a large dedicated external capacitor, C_EXT_FILT1, referenced externally to a local microphone ground, MIC1 GND_REF. The voltage reference MIC1_BIAS_FILT is used as an input to a driver stage amplifier AMP1 112-1 to drive the remote microphone element MIC1 102-1. An external capacitor C_MIC_EXT1 is used as a decoupling capacitor for the remote microphone element MIC1 102-1. The circuit just described is replicated N times with N dedicated external filter caps, C_EXT_FILT1 to C_EXT_FILTN, for an application using N remote microphones MIC1 102-1 to MICN 102-N. For an application using N remote microphones 102, each microphone MICx 102-*x* has a unique and dedicated MICx_BIAS_FILT voltage.

Disadvantages of the prior art scheme of FIG. 1 are that it uses a dedicated external filter capacitor C_EXT_FILTx for each microphone MICx 102-*x*. The dedicated filter capacitor requirement for microphone bias has the following system implications. The filter capacitors use up significant circuit board area, which limits the number of possible microphones in an area-constrained application, such as a cell phone, and adds to system level cost.

Referring now to FIG. 2, a diagram illustrating a possible prior art microphone bias scheme that shares an external filter capacitor, C_EXT_FILT, between multiple microphones 202 is shown. Three microphones MIC1 202-1, MIC2 202-2, and MIC3 202-3 are shown in FIG. 2. The scheme of FIG. 2 is similar to FIG. 1, except the MICBIAS_FILT voltage is not unique for each microphone MICx 202-*x*. The input to the driving stage amplifiers AMP1-AMP3 212-1 to 212-3 is a shared voltage, MICBIAS_FILT. In a system using multiple remote microphones, the scheme of FIG. 2 cannot generate a constant bias voltage across the remote microphones MICx 202-*x* because the MICBIAS_FILT voltage is not generated with respect to the local ground references of each microphone MICx 202-*x*. Additionally, the scheme of FIG. 2 cannot generate a unique bias voltage for each microphone MICx 202-*x* because the input to driving stage amplifiers AMP1-AMP3 212-1 to 212-3 is common.

To reiterate, a disadvantage of the scheme of FIG. 2 is that it does not allow independent control of microphone bias voltages and is unable to generate a unique voltage for each microphone. Further, the scheme of FIG. 2 cannot generate a constant bias voltage across the remote microphones. Finally, it may not be possible to meet system level ground noise rejection requirements with the scheme of FIG. 2.

As mentioned above, certain applications, such as cell phones, require multiple high-performance microphones, which are biased using low noise micbias circuits. Conventional solutions typically use dedicated external filter capacitors for noise filtering of each micbias instance as shown in FIG. 1. The dedicated filter capacitor requirement for microphone bias may have system implications. First, the filter capacitors may use up significant board area. For example, the filter capacitor area for six micbias instances in current technology may be approximately 9 square millimeters (e.g., 4.7 ρF in metric 0402 size). Additionally, the area consumed by the external filter capacitors may limit the number of possible microphones in the system. Finally, the external filter capacitors add to system level cost.

SUMMARY

Embodiments of a microphone bias (micbias) apparatus and method are described that may provide system level advantages over conventional solutions. Embodiments are described that do not require a dedicated external filter capacitor for each micbias/microphone instance. The embodiments may be able to achieve equivalent or better performance using a single shared or no additional external filter capacitor. Additionally, the embodiments provide independent control of each micbias voltage and very high inter-channel isolation. Finally, overall circuit board area savings may be achieved, which may be significant in area-constrained systems, such as cell phone applications.

In one embodiment, the present disclosure provides an apparatus for biasing a plurality of microphones. The apparatus includes a sensing circuit that actively senses a local ground reference for each of the plurality of microphones. The apparatus also includes an intermediate stage that receives a constant non-local reference voltage as an input and responsively provides a respective constant local reference signal with respect to each of the actively sensed local ground references. The apparatus also includes, for each microphone of the plurality of microphones, a respective microphone bias block that uses the respective constant local reference signal to generate a respective constant local microphone bias voltage to bias the microphone.

In another embodiment, the present disclosure provides a method for biasing a plurality of microphones. The method includes actively sensing a local ground reference for each of the plurality of microphones. The method also includes using a constant non-local reference voltage as an input to an intermediate stage that provides a respective constant local reference signal with respect to each of the actively sensed local ground references. The method also includes using, for each microphone of the plurality of microphones, the respective constant local reference signal to generate a respective constant local microphone bias voltage to bias the microphone.

In yet another embodiment, the present disclosure provides a method for biasing a plurality of microphones. The method includes actively sensing a local ground reference for each of the plurality of microphones. The method also includes using a constant non-local reference voltage to generate a respective constant local reference current for each of the plurality of microphones. The method also includes using, for each microphone of the plurality of microphones, the constant local reference current for the microphone to generate a constant local reference voltage for the microphone with respect to the respective actively sensed local ground reference for the microphone. The method also includes using, for each microphone of the plurality of microphones, the constant local reference voltage for the microphone to generate a constant local microphone bias voltage to bias the microphone.

DETAILED DESCRIPTION

Figure 3:
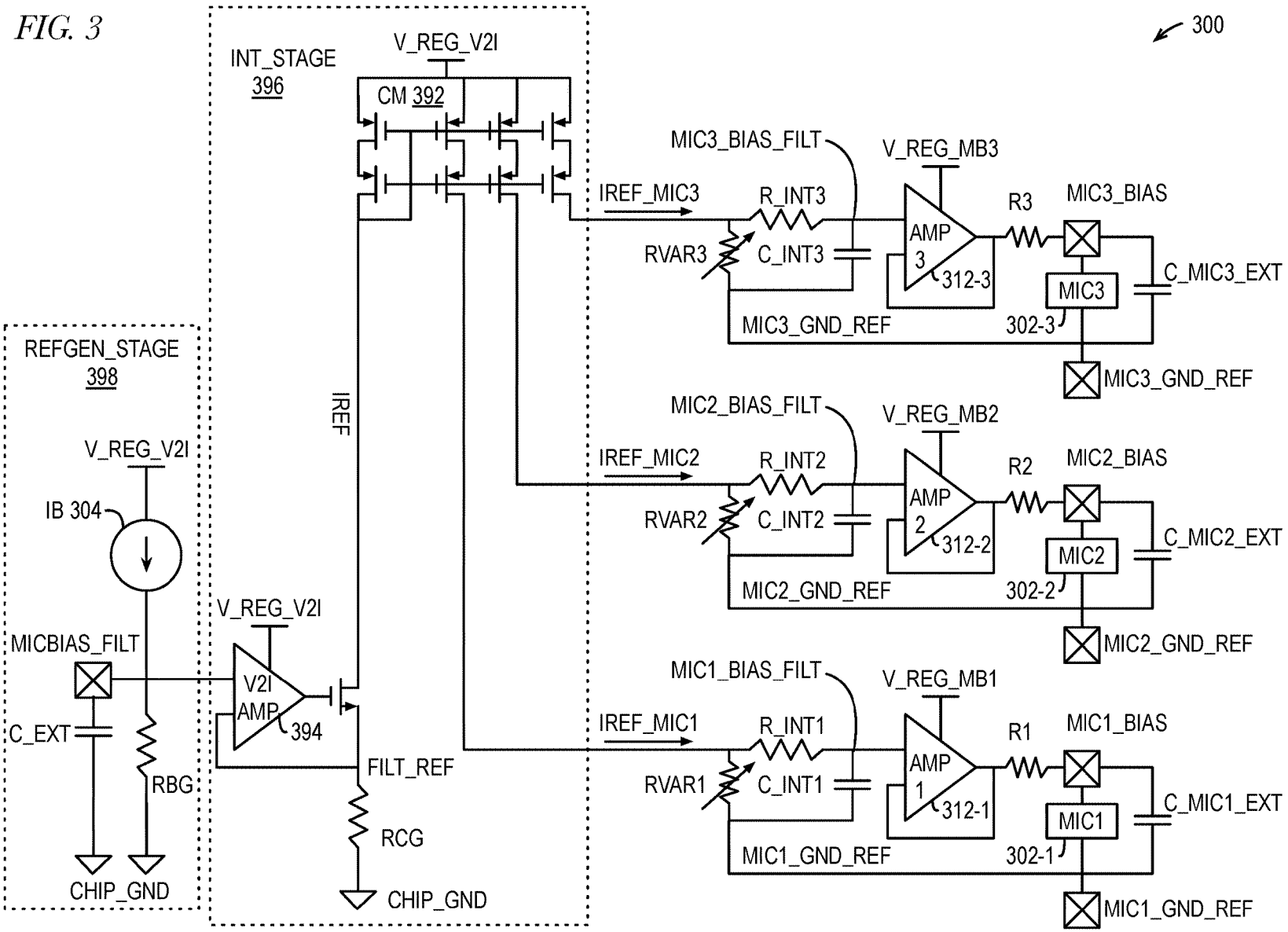
FIG. 3 is a diagram illustrating a microphone bias embodiment that converts a first reference voltage generated with respect to chip ground to respective second reference voltages with respect to respective local microphone grounds by converting the first reference voltage to a reference current which is used to generate the respective second reference voltages.

Referring now to FIG. 3, a diagram illustrating a microphone bias embodiment that converts a first reference voltage generated with respect to chip ground to respective second reference voltages with respect to respective local microphone grounds by converting the first reference voltage to a reference current which is used to generate the respective second reference voltages is shown. In the example of FIG. 3, three micbias circuits for three microphones MIC1 302-1, MIC2 302-2, and MIC3 302-3 are shown. Each microphone MICx 302-*x* has a respective external decoupling capacitor C_MICx_EXT across it, wherein x is either the first (1), second (2), or third (3) respective element/component. It should be understood that although three microphones and associated micbias blocks are shown in FIG. 3, other embodiments are contemplated with other pluralities of instances of microphones and micbias blocks, i.e., the embodiments are not limited to three instances.

In a reference generation stage, REFGEN_STAGE 398, a non-local reference voltage, MICBIAS_FILT, is generated using current IB 304 and a resistor RBG with an external filter capacitor C_EXT in parallel with resistor RBG. Advantageously, the external filter capacitor C_EXT may be relatively small (e.g., 1 μF in metric 0201 size) and may effectively be shared by the microphones MICx 302-*x*, i.e., a single external filter capacitor suffices, as described in more detail below. The reference voltage MICBIAS_FILT is referenced to chip ground CHIP_GND, i.e., ground of an integrated circuit embodying the micbias block embodiments shown. The reference voltage MICBIAS_FILT is fed as input to an intermediate stage INT_STAGE 396.

The intermediate stage INT_STAGE 396 generates respective second local reference voltages, MICx_BIAS_FILT, for the microphones MICx 302-*x* using respective actively sensed local grounds, MICx_GND_REF, for the microphones MICx 302-*x*. The intermediate stage INT_STAGE 396 comprises a voltage-to-current (V2I) amplifier (V2I AMP) 394 for voltage-to-current conversion. The intermediate stage INT_STAGE 396 converts the non-local reference voltage MICBIAS_FILT to a reference current IREF. Current mirrors CM 392 generate respective constant reference currents IREF_MICx for the microphones MICx 302-*x* using the reference current IREF. The constant reference current IREF_MICx outputs of the current mirrors CM 392 generate respective second reference voltages, MICx_BIAS_FILT, which are referenced to the respective actively sensed local microphone ground, MICx_GND_REF.

More specifically, each constant reference current IREF_MICx generates the respective second reference voltage MICx_BIAS_FILT via an RC network associated with the respective microphone MICx 302-*x* coupled between MICx_ BIAS_FILT and MICx_GND_REF, which serves to filter out noise of the associated MICx_BIAS_FILT voltage. Each RC network includes a respective internal capacitor, C_INTx, in parallel with an internal resistor, R_INTx, which is in series with a respective variable resistor, RVARx. The variable resistor RVARx in conjunction with current source IREF_MICx operate as a sensing circuit that actively senses the local microphone ground reference MICx_GND_REF. The variable resistor RVARx may be used to set the bias voltage for the microphone MICx 302-*x* at the MICx_BIAS pin. The ability to independently control the variable resistor RVARx for each corresponding bias voltage MICx_BIAS advantageously allows the setting of different bias voltages for each microphone, which is a system level requirement in some applications. The internal RC network serves a similar noise filtering function as the external filter capacitors C_EXT_FILTx of FIG. 1 and C_EXT_FILT of FIG. 2. Advantageously, the internal capacitors C_INTx can be much smaller (e.g., four orders of magnitude smaller) than the external filter capacitors of the FIGS. 1 and 2. More specifically, the internal capacitors C_INTx can be implemented in silicon on chip using a very reasonable amount of die area. In one embodiment, the value of RVARx is controlled by external firmware to select a final micbias voltage, and the value IREF_MICx is fixed (e.g., in the micro-amp range). The value of RVARx may be chosen to obtain the desired micbias voltage as the product of IREF_MICx*RVARx.

Each second reference voltage MICx_BIAS_FILT is controlled to be constant via the RC network and tracks any changes in the respective local microphone ground MICx_GND_REF. Each second reference voltage MICx_BIAS_FILT is used as input to a respective driving stage amplifier AMPx 312-*x* which provides the constant bias voltage MICx_BIAS to the corresponding microphone MICx 302-*x*. The output of the amplifier AMPx 312-*x* is fed back to its inverting input, and a resistor, Rx, is coupled between the amplifier AMPx 312-*x* output and the MICx_BIAS pin.

Figure 1:
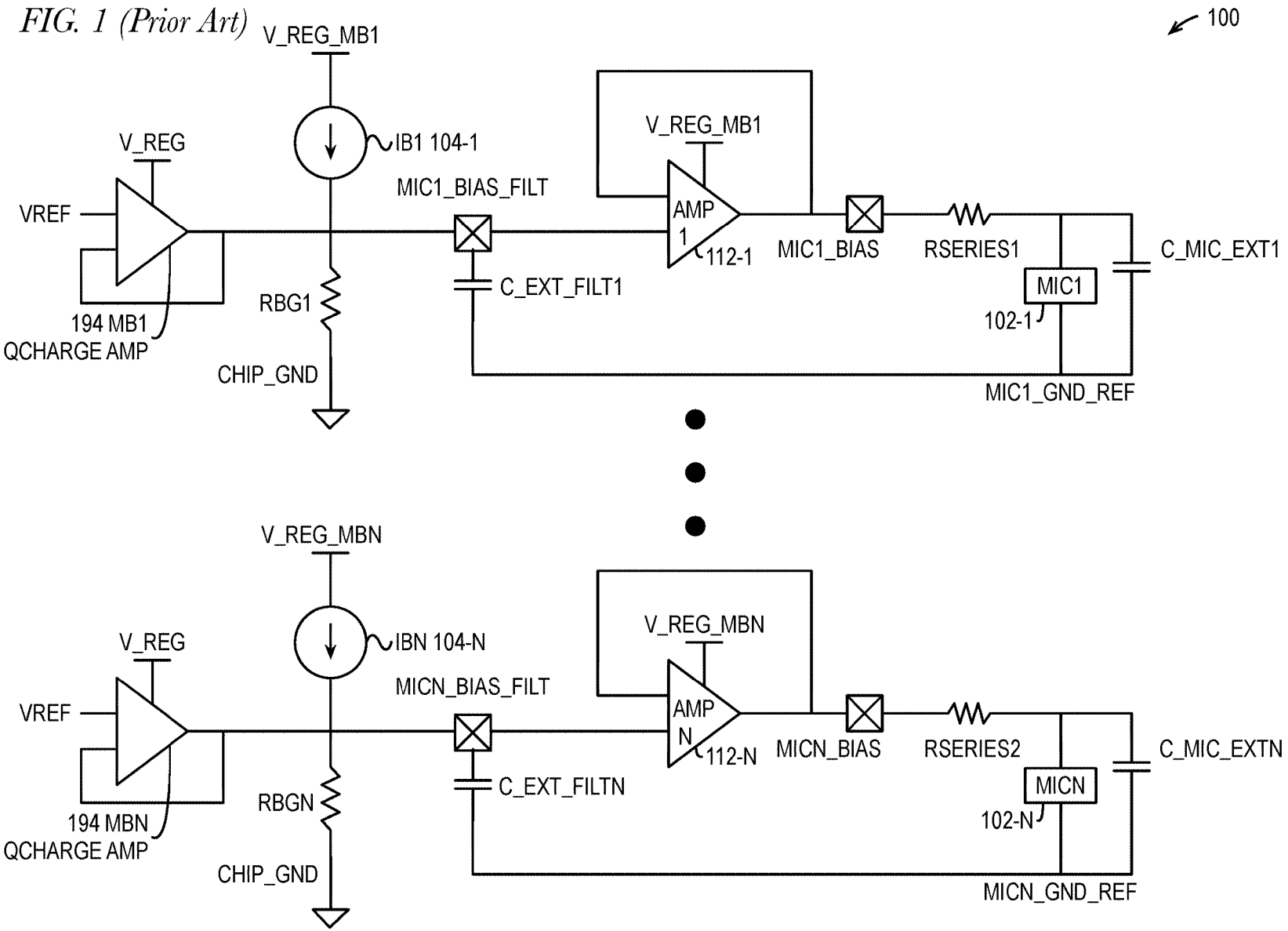
FIG. 1 (Prior Art)
FIG. 1 is a diagram illustrating a prior art microphone bias scheme employing an external capacitor for each of N microphones.
Figure 2:
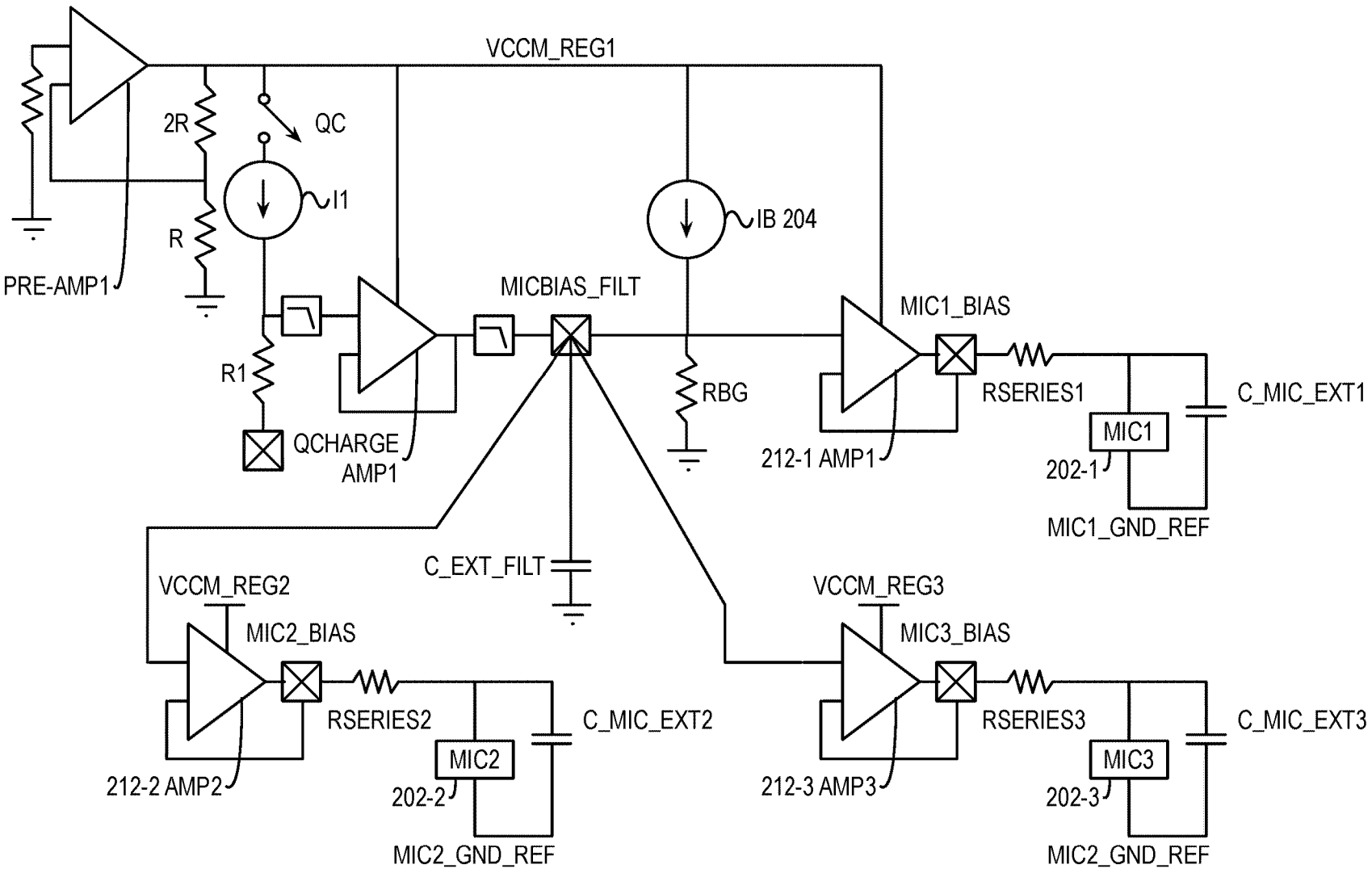
FIG. 2 (Prior Art)
FIG. 2 is a diagram illustrating a prior art microphone bias scheme that shares an external filter capacitor between multiple microphones.

The embodiment of FIG. 3 has various advantages over the conventional approaches of FIGS. 1 and 2. First, the embodiment uses a relatively small shared filter capacitor C_EXT (e.g., 1 μF in metric 0201 size), which may save significant circuit board area over the conventional solutions. This area savings is made possible by the noise filtering internal RC network (RVARx, R_INTx and C_INTx). More specifically, in the embodiments shown in FIG. 3 and FIG. 4, the local microphone grounds are brought into the chip as dedicated pins MICx_GND_REF. These dedicated pins brought into the chip allow decoupling to the local microphone ground MICx_GND_REF using the RC filter network. In contrast, the ground reference is not brought into the chip in the solutions of FIGS. 1 and 2. Furthermore, implementing the filtering internal to the integrated circuit allows the flexibility to use RC filters (e.g., RVARx, R_INTx and C_INTx). A low frequency filter pole may be embodied using a much smaller C_INTx by simply increasing R_INTx. Furthermore, R_INTx may be may be laid out inside the integrated circuit underneath the C_INTx (for example, a poly resistor underneath a metal/MOM (metal-oxide-metal) capacitor). Implementing such a solution externally would be space prohibitive because an external resistor would need to be added for each external filter capacitor, which would consume yet additional circuit board area. Second, the embodiment of FIG. 3 senses the respective microphone ground reference MICx_GND_REF for each microphone MICx 302-*x* and generates a respective constant bias voltage MICx_BIAS for each microphone MICx 302-*x* even in an application using several remote microphones. Third, the embodiment of FIG. 3 allows independent control of the different bias voltage MICx_BIAS levels without requiring an external filter capacitor per microphone MICx 302-*x*. Finally, the embodiment may enable system level noise rejection requirements to be met. Table 1 illustrates simulation results for an embodiment in which the value of the external filter capacitor C_EXT is 1 μF in metric 0201 size.

TABLE 1

| Parameter | | Typical Simulation | Units |
|---|---|---|---|
| Integrated Output Noise (100 Hz~20 kHz) | | 2.3 | μVrms |
| Power Supply Rejection Ratio (Phone VBATT Supply) | 217 Hz | 138 | dB |
| | 1 kHz | 138 | dB |
| | 20 kHz | 137 | dB |
| MICx_GND_REF Voltage Minimum/Maximum Voltage for +/−5% regulation | Absolute Voltage on microphone ground reference with respect to chip ground | −200/+100 | mV |

Figure 4:
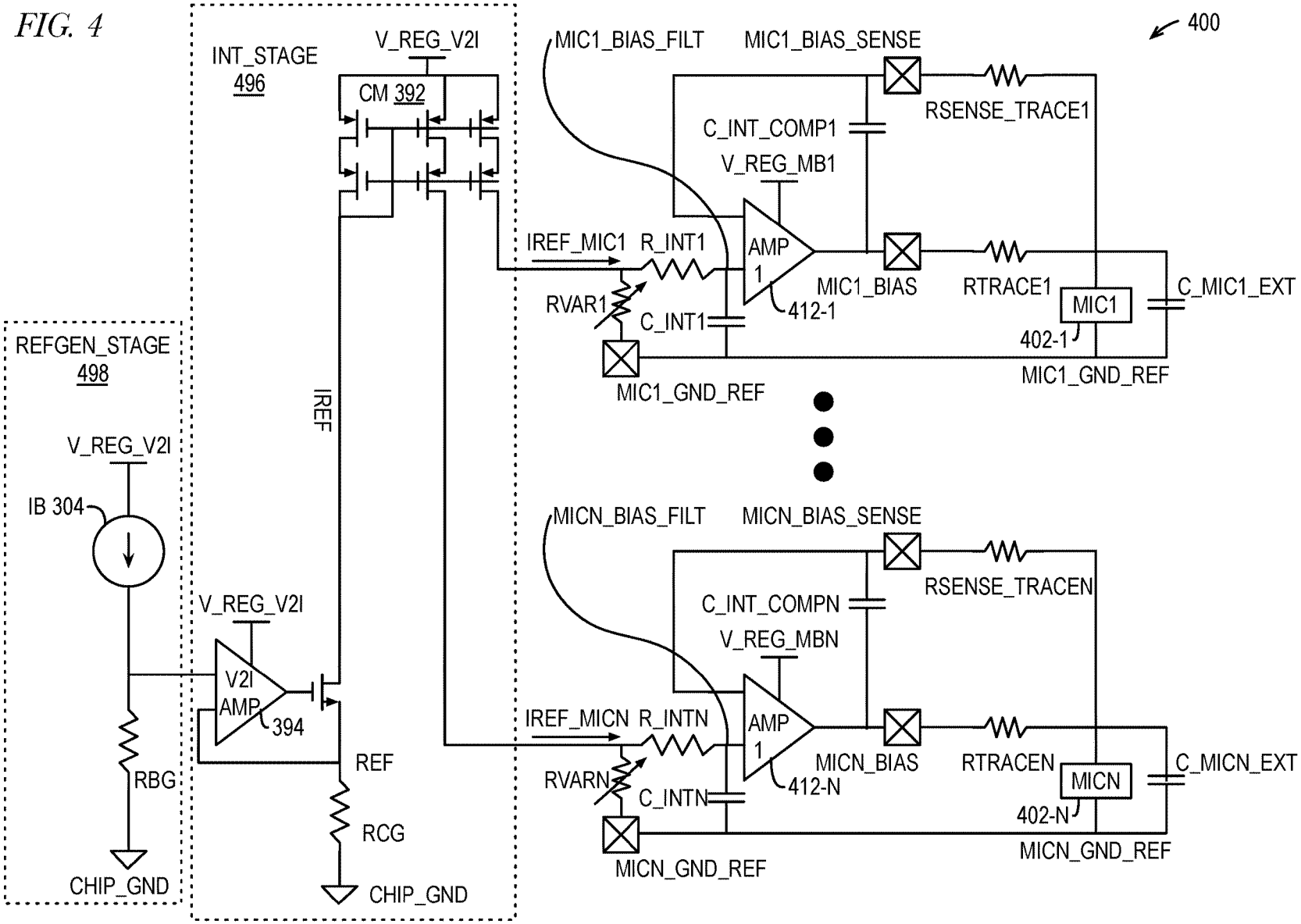
FIG. 4 is a diagram illustrating a microphone bias embodiment that does not use an additional external filter capacitor and that uses a sense input to allow closed loop control of microphone bias voltages with respect to local microphone grounds.

Referring now to FIG. 4, a diagram illustrating a microphone bias embodiment that does not use an additional external filter capacitor and that uses a sense input to allow closed loop control of microphone bias voltages with respect to local microphone grounds is shown. FIG. 4 is similar to FIG. 3 in many respects. In particular, the embodiment of FIG. 4 includes a plurality of microphones, more specifically N remote microphones MIC1 402-1 to MICN 402-N. Each microphone MICx 402-*x* has a respective external decoupling capacitor C_MICx_EXT across it. The embodiment of FIG. 4 also includes a reference generation stage REFGEN_STAGE 498 and an intermediate stage INT_STAGE 496 similar to those of FIG. 3 that are used to generate, for each microphone MICx 402-*x*, a respective second reference voltage MICx_BIAS_FILT that is referenced to a corresponding actively sensed local microphone ground MICx_GND_REF. The second reference voltage MICx_BIAS_FILT is constant and tracks any changes in the local microphone ground MICx_GND_REF. The second reference voltage MICx_BIAS_FILT is used as input to the corresponding driving stage amplifier AMPx 412-*x* which provides the constant bias voltage MICx_BIAS to the microphone MICx 402-*x*. The driving stage amplifier AMPx 412-*x* also uses another sense input, MICx_BIAS SENSE, to allow closed loop control of the microphone bias voltage MICx_BIAS with respect to the microphone ground MICx_GND_REF and to improve accuracy of the bias voltage MICx_BIAS delivered to the microphone MICx 402-*x*. More specifically, the output of the amplifier AMPx 412-*x* is fed back through an internal capacitor, C_INT_COMPx, to the inverting input. The MICx_BIAS pin is coupled to the node formed by the output of the amplifier AMPx 412-*x* and the feedback path. A resistor, RTRACEx, is coupled between the MICx_BIAS pin and the side of the microphone MICx 402-*x* opposite the microphone ground MICx_GND_REF. The MICx_BIAS SENSE pin is coupled to the node formed by the inverting input to the amplifier AMPx 412-*x* and the capacitor C_INT_COMPx. A resistor, RSENSE_TRACEx, is coupled between the MICx_BIAS SENSE pin and the side of the microphone MICx 402-*x* opposite the microphone ground MICx_GND_REF. In one embodiment, RTRACEx and RSENSE_TRACEx are routes on a printed circuit board having controlled impedance. A respective RC network similar to that described with respect to FIG. 3 is coupled between the non-inverting input of each amplifier AMPx 412-*x* and the microphone ground reference MICx_GND_REF similar to the embodiment of FIG. 3. The constant reference current IREF_MICx generates the second reference voltage MICx_BIAS_FILT via the RC network, which also serves to filter out noise thereof. The second reference voltage MICx_BIAS_FILT is controlled to be constant via the RC network and tracks any changes in the respective local microphone ground MICx_GND_REF.

Although REFGEN_STAGE 398 of FIG. 3 includes an external filter capacitor C_EXT, the REFGEN_STAGE 498 of FIG. 4 advantageously does not. The external filter capacitor C_EXT is not needed because in the embodiment of FIG. 4 each microphone bias voltage MICx_BIAS is remotely sensed, via the respective MICx_BIAS SENSE pin, in addition to the remote sensing of each local microphone ground reference MICx_GND_REF. The ability to remotely sense each microphone bias voltage MICx_BIAS as part of the operational amplifier AMPx 412-*x* loop allows direct filtering at the microphone MICx 402-*x* using the decoupling capacitor C_MICx_EXT. Thus, the decoupling capacitor C_MICx_EXT serves the dual purposes of decoupling and noise filtering and alleviates the need for the external filter capacitor C_EXT.

Additionally, the external decoupling capacitor C_MICx_EXT may be smaller than the corresponding decoupling capacitors of FIGS. 1 and 2 because of the ability to remotely sense both the microphone bias voltage MICx_

BIAS (via the MICx_BIAS SENSE pin) and ground reference MICx_GND_REF and by closing the operational amplifier loop around it. The presence of this feedback loop enables more effective regulation of the microphone bias voltage MICx_BIAS. Thus, advantageously, the external decoupling capacitor C_MICx_EXT needs to provide a relatively small amount of decoupling and filtering. In contrast, the conventional solutions of FIGS. 1 and 2 require relatively large corresponding capacitors (e.g., 4.7 uF in metric 0402 size) to filter noise and improve regulation because they are absent the active sensing capability of the embodiments of FIGS. 3 and 4.

Figure 5:
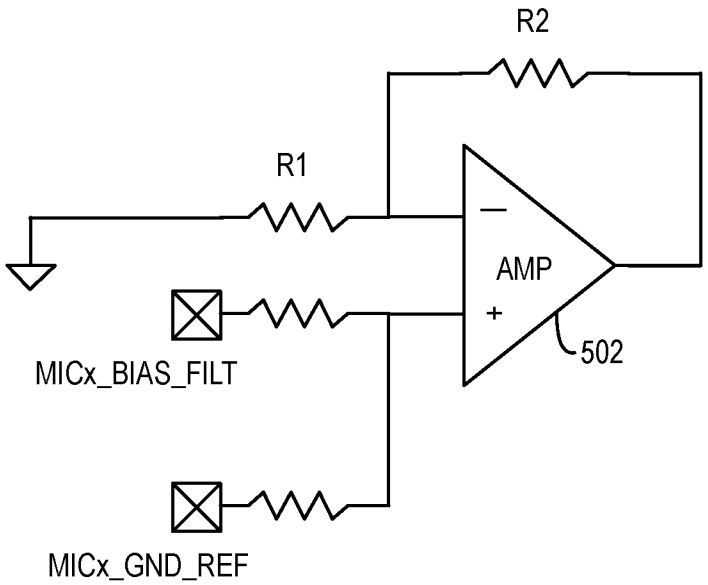
FIG. 5 is a diagram illustrating an alternate embodiment of a sensing circuit.

Referring now to FIG. 5, a diagram illustrating an alternate embodiment of a sensing circuit 500 is shown. The sensing circuit 500 is an op-amp summer-based sense circuit. In the embodiment of FIG. 5, the sensing circuit is configured to sense a local microphone ground reference MICx_GND_REF. The sensing circuit comprises an operation amplifier, AMP 502, having attached to its non-inverting input the MICx_BIAS_FILT pin through a resistor and the MICx_GND_REF pin through another resistor. The inverting input to the amplifier AMP 502 is coupled to ground through a resistor R1 and the output of the amplifier AMP 502 is fed back through a resistor R2 to the inverting input.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure makes reference to specific embodiments, certain modifications and changes can be made to those embodiments without departing from the scope and coverage of this disclosure. Moreover, any benefits, advantages, or solutions to problems that are described herein with regard to specific embodiments are not intended to be construed as a critical, required, or essential feature or element.

Further embodiments likewise, with the benefit of this disclosure, will be apparent to those having ordinary skill in the art, and such embodiments should be deemed as being encompassed herein.

The invention claimed is:

1. An apparatus for biasing a plurality of microphones, the apparatus comprising:

a sensing circuit that actively senses a local ground reference for each of the plurality of microphones;

an intermediate stage that receives a constant non-local reference voltage as an input and responsively provides a respective constant local reference signal with respect to each of the actively sensed local ground references; and for each microphone of the plurality of microphones, a respective microphone bias block that uses the respective constant local reference signal to generate a respective constant local microphone bias voltage to bias the microphone.

2. The apparatus of claim 1, further comprising:

wherein each respective constant local reference signal comprises a respective current; and wherein each respective microphone bias block uses the respective current to generate a respective constant local reference voltage for the microphone with respect to the actively sensed local ground reference of the microphone.

3. The apparatus of claim 2, further comprising:

for each microphone of the plurality of microphones, a respective driving stage for the microphone that uses the respective constant local reference voltage for the microphone as input and provides the respective constant local microphone bias voltage to bias the microphone.

4. The apparatus of claim 2, further comprising:

for each microphone of the plurality of microphones, a variable resistor-capacitor (RC) network that uses the respective current to generate a constant local reference voltage for the microphone; and wherein each of the RC networks is controllable in response to the respective actively sensed local ground reference to independently set the respective local microphone bias voltage to bias the respective microphone.

5. The apparatus of claim 4, further comprising:

wherein the apparatus comprises an integrated circuit; and wherein, for each microphone of the plurality of microphones, the respectively controllable variable resistor-capacitor (RC) network comprises a filter capacitor internal to the integrated circuit, thereby alleviating a need for an external filter capacitor for each of the microphones.

6. The apparatus of claim 2, further comprising:

a voltage-to-current conversion stage that converts the constant non-local reference voltage to a constant non-local reference current.

7. The apparatus of claim 6, further comprising:

a current mirror that uses the constant non-local reference current to generate the respective constant local reference currents for the plurality of microphones.

8. The apparatus of claim 7, further comprising:

a sensing circuit that actively senses, for each microphone of the plurality of microphones, the respective constant local microphone bias voltages.

9. The apparatus of claim 8, further comprising:

for each microphone of the plurality of microphones, a closed loop driving stage that uses as inputs the actively sensed constant local microphone bias voltage and the constant local reference voltage for the microphone with respect to the respective actively sensed local ground reference for the microphone to generate the respective constant local microphone bias voltage to bias the microphone.

10. The apparatus of claim 6, further comprising:

wherein the apparatus comprises an integrated circuit; and a filter capacitor external to the integrated circuit that couples the voltage-to-current conversion stage to a ground of the integrated circuit.

11. A method for biasing a plurality of microphones, the method comprising:

actively sensing a local ground reference for each of the plurality of microphones;

using a constant non-local reference voltage as an input to an intermediate stage that provides a respective constant local reference signal with respect to each of the actively sensed local ground references; and using, for each microphone of the plurality of microphones, the respective constant local reference signal to generate a respective constant local microphone bias voltage to bias the microphone.

12. The method of claim 11, further comprising:

wherein each respective constant local reference signal comprises a respective current; and using, for each microphone of the plurality of microphones, the respective current to generate a constant local reference voltage for the microphone with respect to the actively sensed local ground reference of the microphone.

13. The method of claim 12, further comprising:

wherein said using, for each microphone of the plurality of microphones, the respective constant local reference signal to generate a respective constant local microphone bias voltage to bias the microphone is performed by a respective driving stage for the microphone that uses the constant local reference voltage for the microphone as input and provides the respective constant local microphone bias voltage.

14. The method of claim 12, further comprising:

wherein said using, for each microphone of the plurality of microphones, the respective current to generate a constant local reference voltage for the microphone is performed by a variable resistor-capacitor (RC) network for the microphone; and controlling, for each microphone of the plurality of microphones, the variable RC network for the microphone to independently set the local microphone bias voltage to bias the microphone in response said actively sensing a local ground reference.

15. The method of claim 14, further comprising:

wherein the method is performed by an integrated circuit; and wherein, for each microphone of the plurality of microphones, the respectively controllable variable resistor-capacitor (RC) network comprises a filter capacitor internal to the integrated circuit, thereby alleviating a need for an external filter capacitor for each of the microphones.

16. A method for biasing a plurality of microphones, the method comprising:

actively sensing a local ground reference for each of the plurality of microphones;

using a constant non-local reference voltage to generate a respective constant local reference current for each of the plurality of microphones;

using, for each microphone of the plurality of microphones, the constant local reference current for the microphone to generate a constant local reference voltage for the microphone with respect to the respective actively sensed local ground reference for the microphone; and using, for each microphone of the plurality of microphones, the constant local reference voltage for the microphone to generate a constant local microphone bias voltage to bias the microphone.

17. The method of claim 16, further comprising:

converting, by a voltage-to-current conversion stage, the constant non-local reference voltage to a constant non-local reference current; and using the constant non-local reference current to generate the constant local reference current for each of the plurality of microphones.

18. The method of claim 17, wherein using the constant non-local reference current to generate the constant local reference current for each of the plurality of microphones is performed by a current mirror.

19. The method of claim 16, further comprising:

actively sensing, for each microphone of the plurality of microphones, the constant local microphone bias voltage.

20. The method of claim 19, further comprising:

wherein said using, for each microphone of the plurality of microphones, the constant local reference voltage for the microphone to generate a constant local microphone bias voltage to bias the microphone is performed by a closed loop driving stage that uses as inputs the actively sensed constant local microphone bias voltage and the constant local reference voltage for the microphone with respect to the respective actively sensed local ground reference for the microphone.

* * * * *